US006113445A

United States Patent [19]

Trosclair

[11] Patent Number: 6,113,445

[45] Date of Patent: Sep. 5, 2000

[54] MULTI-ELEMENT, LINE CUTTING AND PROP HOLDING SYSTEM FOR A MARINE PROPELLER

[76] Inventor: Hayes J. Trosclair, 1530 Fos Ave., Harvey, La. 70058

[21] Appl. No.: 09/349,610

[22] Filed: Jul. 8, 1999

[51] Int. Cl.[7] ..... B63M 1/28

[52] U.S. Cl. ..... 440/73; 416/146 R

[58] Field of Search ..... 416/146 R; 440/49, 440/73, 900

[56] References Cited

U.S. PATENT DOCUMENTS

| | | | |
|---|---|---|---|
| 67,982 | 8/1867 | Hudson . | |
| 425,019 | 4/1890 | Brower et al. . | |
| 726,180 | 4/1903 | Miller | 440/73 |
| 732,568 | 6/1903 | Lee | 440/73 |
| 1,649,657 | 11/1927 | Blake . | |
| 2,319,947 | 5/1943 | Oswood . | |
| 2,690,728 | 10/1954 | Cavanaugh . | |
| 3,467,052 | 9/1969 | Hadler . | |
| 4,246,862 | 1/1981 | Deal . | |
| 4,447,214 | 5/1984 | Henrich . | |
| 4,447,215 | 5/1984 | Govan . | |
| 4,450,670 | 5/1984 | Robinson . | |
| 4,507,091 | 3/1985 | Govan . | |
| 4,544,363 | 10/1985 | Govan . | |
| 4,578,040 | 3/1986 | Sumino et al. . | |
| 4,594,108 | 6/1986 | Greminger . | |
| 4,609,361 | 9/1986 | Sumino et al. . | |
| 4,676,758 | 6/1987 | Dennis . | |
| 4,718,871 | 1/1988 | Mendelevitch . | |
| 4,801,281 | 1/1989 | Govan . | |
| 4,898,552 | 2/1990 | Cochran . | |
| 4,911,664 | 3/1990 | Gremillion . | |
| 4,938,724 | 7/1990 | Shaw . | |
| 4,943,249 | 7/1990 | Govan . | |
| 4,954,108 | 9/1990 | Govan . | |
| 5,007,867 | 4/1991 | Keeley . | |
| 5,017,167 | 5/1991 | Govan . | |
| 5,052,957 | 10/1991 | Govan . | |
| 5,807,150 | 9/1998 | Minter, Sr. . | |

*Primary Examiner*—Stephen Avila
*Attorney, Agent, or Firm*—Pugh/Associates; C. Emmett Pugh

[57] ABSTRACT

A marine system using a number of different cutting and grinding members positioned at different parts of a marine screw prop shaft adjacent or around the prop for clearing away any line or rope entanglements, particularly for marine props on large commercial vessels. The cutting/grinding edges and surfaces are positioned in differing directions and angles, some with supplemental, opposed members to assist in the rope cutting/abrading, severing process. The rope cutting/abrading structure likewise holds the prop to the vessel should the shaft driving the propeller break, preventing its loss. The preferred embodiment includes a set of outer, aft directed arms and a nested set of inner, substantially forwardly directed arms, each carrying, interactive, side edge cutting or abrading surfaces, with the number of arms coinciding with the number of blades on the associated propeller. The inner set of arms are fixed to the hub of the propeller, with its arms positioned at the open spaces between the prop blades, with its forward ends terminating in a sidewardly directed or angled set of extensions having cutting edges and extending down past the back side of an interactive, circular, abrading wheel, producing an interlocking, interfacing of the two together, preventing a propeller from being lost should a propeller shaft break.

26 Claims, 4 Drawing Sheets

MULTI-ELEMENT, LINE CUTTING AND PROP HOLDING SYSTEM FOR A MARINE PROPELLER

TECHNICAL FIELD

The present invention relates to a marine system using a number of different cutting and grinding members positioned at different parts of a marine screw prop shaft adjacent or around the prop for clearing away any line or rope entanglements, particularly for marine props on large commercial vessels. The cutting/grinding edges and surfaces are positioned in differing directions and angles, some with supplemental, opposed members to assist in the rope cutting/abrading process. The present invention further relates to the rope cutting/abrading structure likewise being used to hold the prop to the vessel should the shaft driving the propeller break.

BACKGROUND ART

Large commercial vessels traveling through navigable waters will occasionally pass over ropes that become suspended in the water based on the material from which the ropes are made. As these vessels pass over the rope, often it becomes entangled in the propeller.

The rope wraps itself around the propeller, balling around the propeller and shaft, causing (1) the shaft to break and the propeller to sink, or (2) the shaft to be drawn out of the vessel and the propeller to sink and be lost, causing a significant financial loss, and often substantially delaying when the vessel can get back up underway again.

However, to cure these problems, the preferred rope cutting and propeller hitch device of the present invention prevents the rope from staying wrapped and balled around the propeller and/or shaft by cutting it into non-entangling segments, retains the propeller should the shaft break, and keeps the shaft from being drawn out of the vessel.

A listing of prior patents, which may be relevant to the invention, is presented below:

| U.S. Pat. No. | Patentee(s) | Issue Date |
|---|---|---|
| 0,067,982 | Hudson | 20 Aug 1867 |
| 0,425,019 | Bower, et al | 08 Apr 1890 |
| 1,649,657 | Blake | 15 Nov 1927 |
| 2,319,947 | Oswood | 25 May 1943 |
| 2,690,728 | Cavanaugh | 05 Oct 1954 |
| 3,467,052 | Hadler | 16 Sept 1969 |
| 4,246,862 | Deal | 27 Jan 1981 |
| 4,447,214 | Henrich | 08 May 1984 |
| 4,447,215 | Govan | 08 May 1984 |
| 4,450,670 | Robinson | 29 May 1984 |
| 4,507,091 | Govan | 26 Mar 1985 |
| 4,544,363 | Govan | 01 Oct 1985 |
| 4,578,040 | Sumino et al | 25 May 1986 |
| 4,594,108 | | |
| 4,609,361 | Sumino et al | 02 Sept 1986 |
| 4,676,758 | Dennis | 30 Jun 1987 |
| 4,718,871 | Mendelevitch | 12 Jan 1988 |
| 4,801,281 | Govan | 31 Jan 1989 |
| 4,898,552 | Cochran | 06 Feb 1990 |
| 4,911,664 | Gremillion | 27 Mar 1990 |
| 4,938,724 | Shaw | 03 Jul 1990 |
| 4,943,249 | Govan | 24 Jul 1990 |
| 4,954,108 | Govan | 04 Sept 1990 |

-continued

| U.S. Pat. No. | Patentee(s) | Issue Date |
|---|---|---|
| 5,007,867 | Kelley | 16 Apr 1991 |
| 5,017,167 | Govan | 21 May 1991 |
| 5,052,957 | Govan | 01 Oct 1991 |
| 5,807,150 | Minter, Sr. | 15 Sep 1998 |

The broad concept of using a cutting edge to clear a screw prop goes as far back as at least as 1867 (note U.S. Pat. No. 67,982; note also U.S. Pat. No. 425,019 of 1890).

The most prolific inventor in the field appears to be Donald T. Govan of Ft. Lauderdale, Fla., who has been granted at least eight patents ('215, '091, '363, '281, '249, '108, '167 & '957).

A pertinent patent is the patent to Minter (U.S. Pat. No. 5,807,150) directed to a blade system for cutting weeds and other aquatic vegetation on a marine motor (e.g. a trolling motor). The Minter patent discloses the use of a series of backwardly directed, generally longitudinally extending series of blade bodies 7 peripherally spaced about the screw prop shaft with edge cutting surfaces or serrations 11, with each of the blades 7 mounted at an angle to the center line on a ramp or wedge shaped mount 2 with the cutting edge of the blade facing tangentially. The above referenced patents show a number of different approaches for clearing lines or cutting away aquatic vegetation, using various type of cutting or grinding surfaces, some having similarities to the invention.

As will be seen more fully below, the present invention is substantially different in structure, methodology and approach from that of the prior patents.

GENERAL DISCUSSION OF INVENTION

As noted above, the present invention relates to a marine system using a number of different, interactive, cutting and grinding members directed differently and at differing angles and positioned at different parts of a marine screw prop shaft adjacent to or around the prop for clearing away any line entanglements. The cutting/grinding edges are positioned in differing directions, some with supplemental, opposed members to assist in the cutting and abrading process. In the preferred embodiment of the invention these enhanced, interactive cutting and abrading actions are achieved by using an inner and outer frameworks carrying various cutting edges and serrated, abrading surfaces, one framework with legs extending back in the aft direction and the other with legs extending in the forward direction, and one of which rotates with respect to the other. To achieve the hitch or holding action for preventing loss of the propeller, should a shaft break, the set of arms extending in the forward direction overlaps the back side of the fixed framework or other part(s) of the fixed structure, preventing the inner and outer frameworks from being pulled apart.

To cure the prior art problems noted above, the rope cutting and propeller hitch or holding device of the present invention prevents the rope from wrapping and prevents balling of the rope around the propeller and/or shaft, retaining the propeller should the shaft break, and keeping the shaft from being drawn out of the vessel.

The preferred embodiment of the present invention utilizes the natural tendency of any entangled rope to wrap around the propeller and to draw taunt or tightly around the propeller blades and provides angularly disposed blades or abrading surfaces to sheer the rope at each of its location between the propeller blades and/or abrading surfaces. The device of the invention is generally configured for the various particular propeller installations that exist in the marketplace. Because most of the structure of the device of the invention is within the size of the propeller, it has a minimal effect on the operation of the marine vessel to which it is applied.

The use of the present invention is directed basically to all propeller commercial aquatic vessels, including, but not limited to, ocean liners, commercial fishing vessels, tugboats, harbor boat, push-boats, tankers, containerized ships, grain or commodity vessels, etc.

It is noted that many, if not most, vessels are chartered or leased on a time basis. The cost of down-time due to getting such a vessel to dry dock that had access to propellers of the size required will be minimized. The time to get to any dry dock, since, with the preferred embodiment of the invention, the propeller is retrievable, will the reduce the "lost time" for the owners or lessees of the vessels that use the invention. Also, since the blades will sheer away any entanglement, the likelihood of incurring down-time will be significantly reduced with the use of the present invention.

The above and other objects of the present invention will become more apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein.

DESCRIPTION OF THE PREFERRED EMBODIMENT

Figure 5:
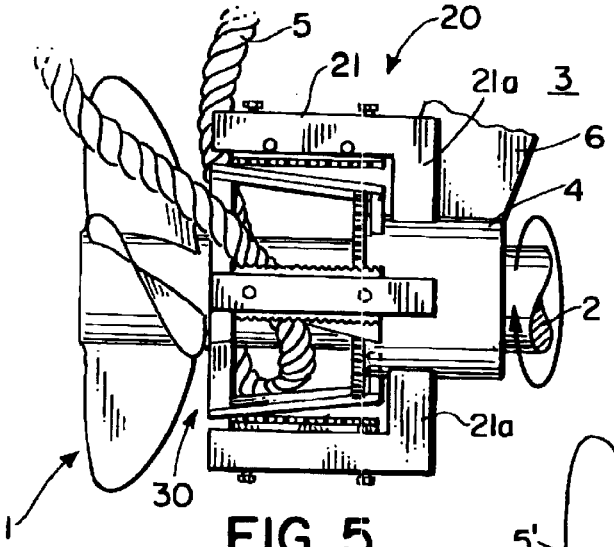
FIG. 5 is a side view of the embodiment of FIG. 1, similar to FIG. 1 but showing a line or rope being entangled around the marine prop.
Figure 6:
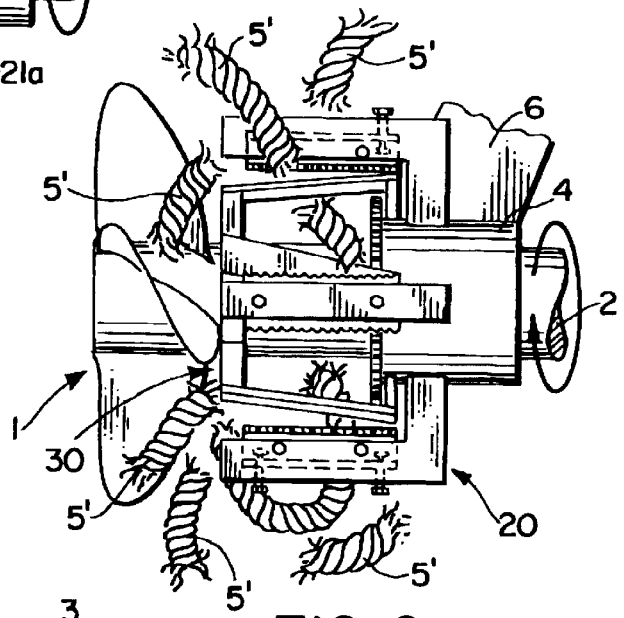
FIG. 6 is another side view of the embodiment of FIG. 1, similar to FIG. 5, but showing the entangled line or rope being cut into pieces by the various, multi-element, line cutting system of the exemplary embodiment of the invention.

As is known, a typical marine propulsion system includes at least one, exemplary propeller 1 (having, for example, four blades 1*b* as illustrated) fixedly attached at the end of a rotatable shaft 2, with the shaft being carried by the marine hull 3 and held in place by a suitable structure, such as, for example, the journal bearing or stuffing box 4, which allows the shaft 2 to rotate within the interior bearing but which otherwise holds it in place on the hull. As is also known, sometimes a rope or line 5 (see FIG. 5) becomes entangled in the rotating prop and shaft 1/2, which needs to be removed; while at other times a shaft can break off, allowing the propeller 1 to break away from the remainder of the shaft 2*b*, causing it to fall away from the marine vessel 3 and become lost.

As shown in FIGS. 1–4 and 8–10, the exemplary, currently preferred embodiment 10 of the multi-element, line cutting and prop holding system for a marine propeller of the present invention includes an outer framework 20 which is attached to the prop support or stuffing box 4, remaining fixed therewith, and a series of multi-element, line cutting devices, some of which have parts that are carried by and rotated with the propeller/shaft 1/2, as well as other parts that are fixed and remain stationary with respect to the marine vessel's hull 3, as will be explained more fully below.

Figure 1:
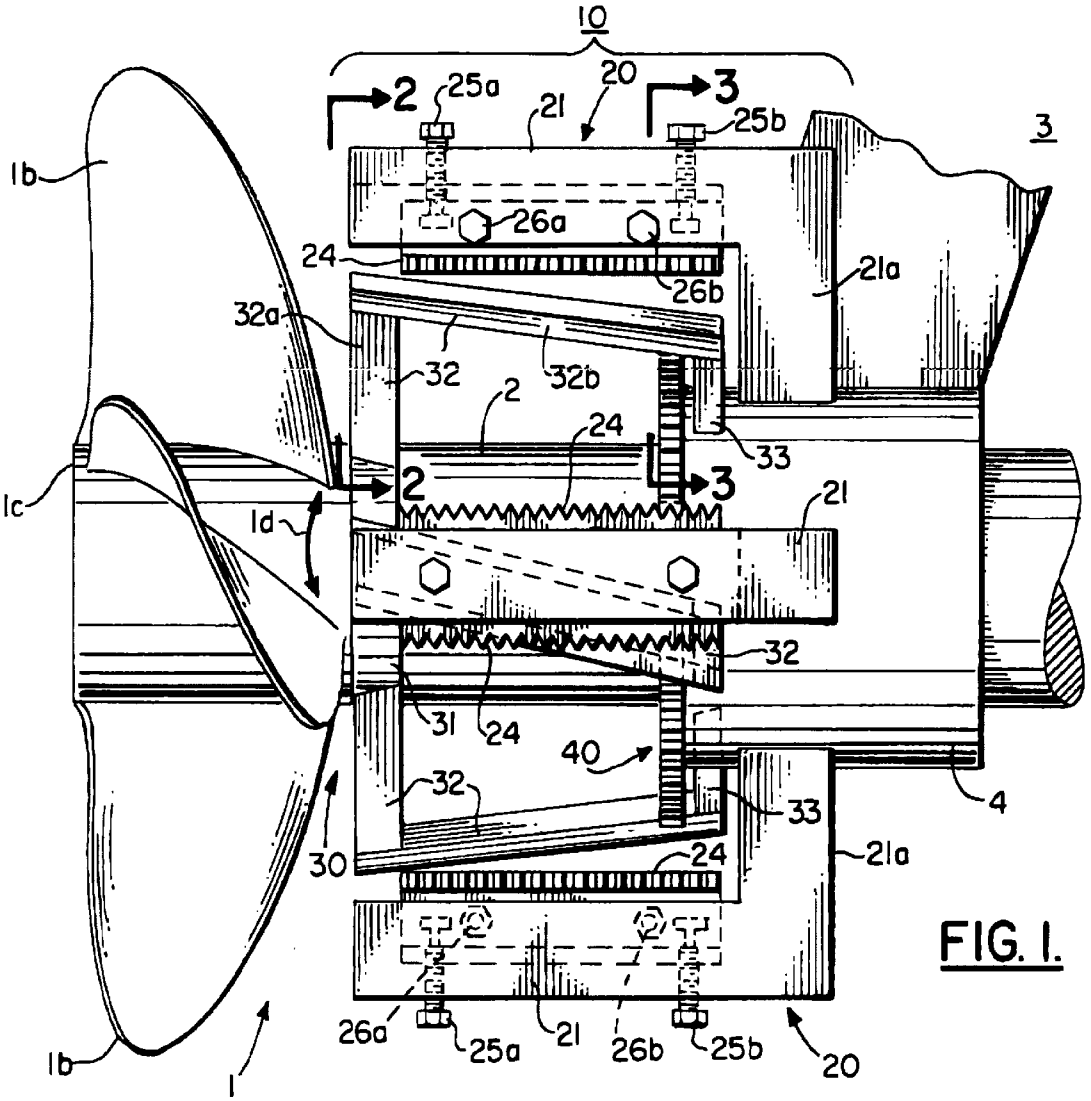
FIG. 1 is a side view of the exemplary, preferred embodiment of the multi-element, line cutting system for a marine propeller of the present invention, with several, otherwise unseeable elements shown in phantom line.
Figure 2:
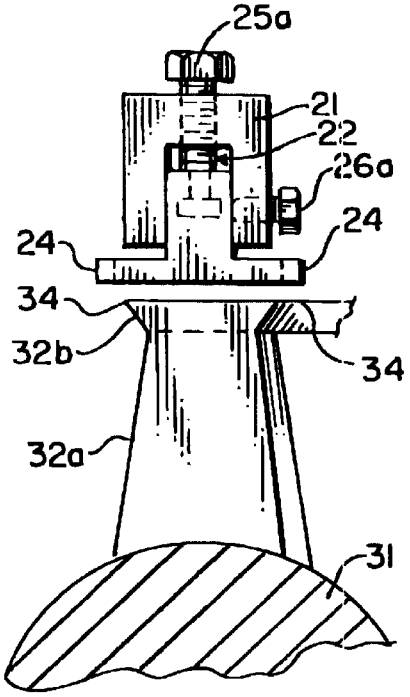
FIG. 2 is a partial, cross-sectional, detail view taken along section lines 2—2 of the embodiment of FIG. 1.
Figure 3:
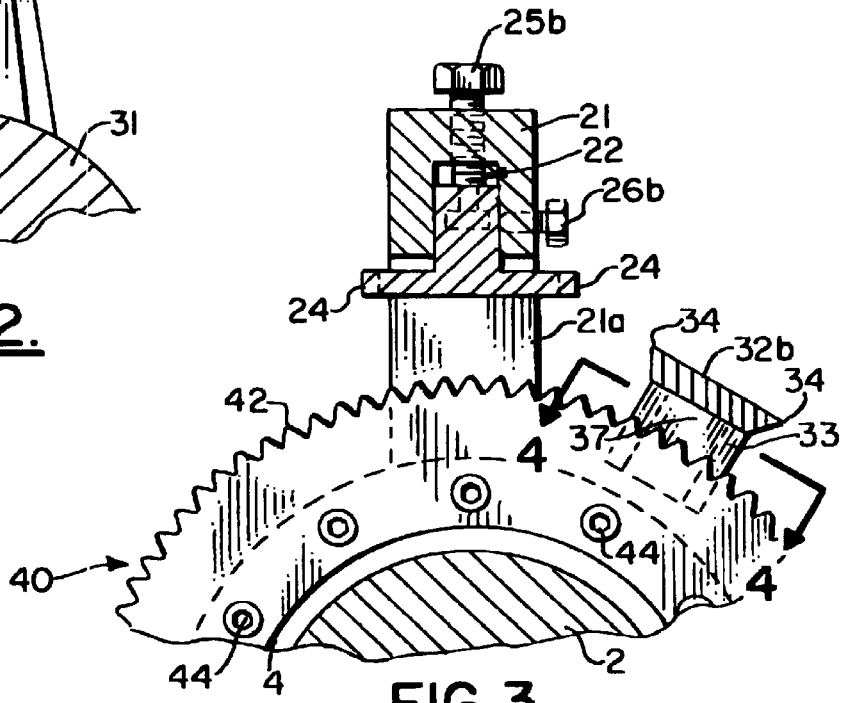
FIG. 3 is a another, partial, cross-sectional, detail view, taken along section lines 3—3 the embodiment of FIG. 1.
Figure 4:
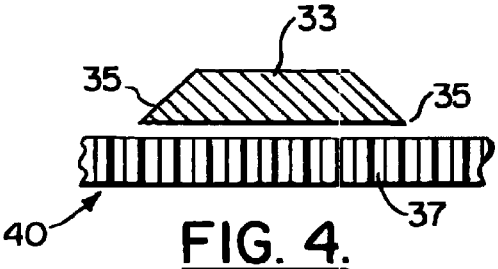
FIG. 4 is a partial, cross-sectional, detail view taken along section lines 4—4 in FIG. 3 of the embodiment of FIG. 1.

As can be seen in FIGS. 2 & 3, the outer, stationary framework 20 includes an exemplary set of four arms 21 initially extending radially out (21*a*) and then extending longitudinally back toward the propeller 1, with the four arms being positioned, one at each ninety (90°) degree segment of the circle defined by the rotating propeller 1. Each arm includes a channel 22 which carries a removable and replaceable, laterally extended rope abrader 23 using longitudinally extended, serrated surfaces 24 to abrade any entangled, rope line 5.

The rope abraders 23 are each held in their respective channels 22 by a set of radially extending, set screws or bolts 25*a* & 25*b* and a pair of tangentially extending, set screws or bolts 26*a* & 26*b*. This attachment arrangement allows the rope abraders 23 to be easily replaced as they become worn or damaged.

A rotating, inner, prop holder and cutting framework 30, that rotates with the shaft 2 and propeller 1, is positioned interiorly within the area defined by the arms 21 of the outer framework 20. The rotating, interior or inner framework 30 includes an aft, circular collar 31 (note particularly FIGS. 1 & 10) which is preferably welded or otherwise attached to the backside surface of the hub 1*a* (note generally FIG. 8) of the propeller 1 or is attached to the shaft 2 with an exemplary set of four arms 32, initially radially extending out (32*a*) and then extending back (32*b*) generally in a longitudinal direction, but with the back extending portion being angled down and to the side at an angle a (note again FIGS. 10 & 1), preferably as each one extends forward toward the shaft journal bearing 4).

As noted, in the description of the exemplary embodiment above, because there were four blades 1*b* on the prop 1, a corresponding number of equi-spaced, outer arms and inner arms 21/32 was likewise provided. The number of outer and inner arms 21/32 preferably are the same as the number of propeller blades 1*b*, with the inner set of arms 32 fixedly positioned on the hub 1*c* to correspond with the openings or spaces 1*d* between the blades 1*b* (note the position of the center one of the inner arms 32 in FIG. 1), preferably with the sideward angle α (FIG. 10) of the upper portion 32*b* being aligned with the pitch or angle of the open area of the prop blade spacing 1*d*.

This alignment and relative positioning of the various elements enhance the effectiveness of the interactive, line cutting and abrading actions, because at least in substantial part any incoming rope or line 5 will enter the area occupied by the outer and inner frameworks 20/30 through the spacings 1*d* between the rotating blades 1*b*. The rope 5 is thus led directly to the entry of the rotating side cutting edges 34/134, which then will produce highly effective cutting and abrasive actions as the inner arms' angled, side cutting edges 34/134 swing past in close proximity to the side, serrated, abrading surfaces 24 (note relative positions shown in FIG. 2, with the following scissoring action caused by the "delayed" passing of the forward edges 34/134 as indicated in FIG. 3).

The forward ends 33 of the arms 32 extend back down behind the fixed abrading wheel 40, described more fully below. As can best be seen in FIG. 10, each end 33 forms a cutting blade [with side (35) and bottom (36) cutting edges] that is swept around in close proximity to the back side 41 of the fixed abrading wheel 40 and right over and above the fixed, cylindrical, exterior surface of the stuffing box 4, providing a highly interactive cutting action for any rope 5 that might get entangled about the shaft 2 in the area adjacent to the stuffing box 4.

Figure 7:
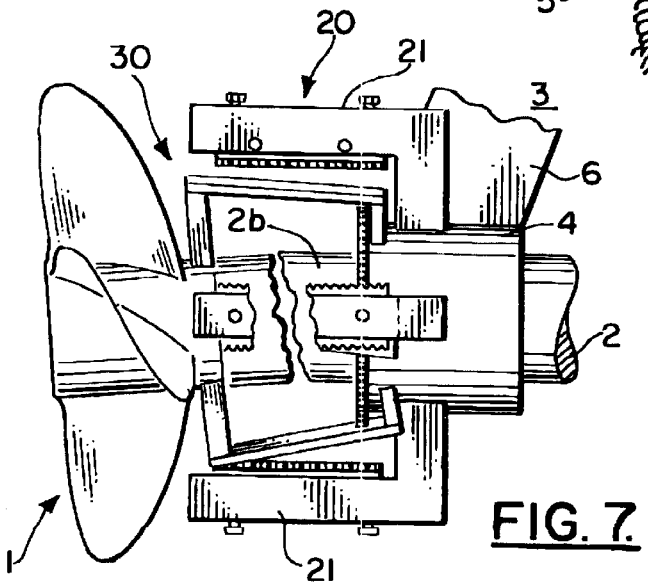
FIG. 7 is still another side view of the embodiment of FIG. 1, similar to FIGS. 5 & 6, but showing the prop-saving action of the prop holding structure of the exemplary embodiment of the invention, when the prop shaft is broken, part of which prop holding structure is cut-away in the figure to better show the break in the prop shaft; this framework maintains a connection between the prop and the hull structure should the shaft ever break, preventing the loss of the prop.
Figure 8:
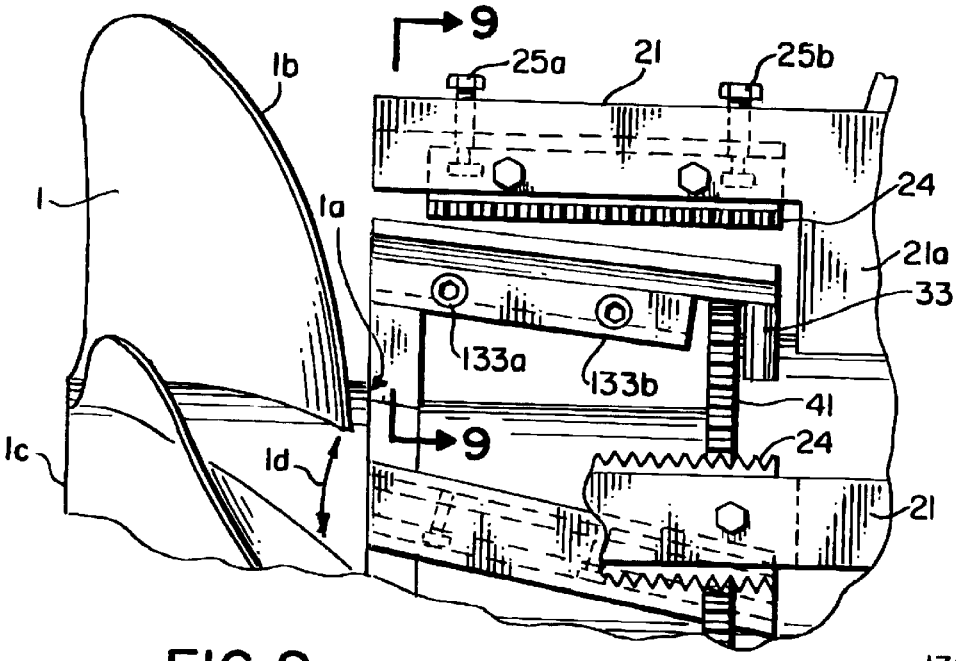
FIG. 8 is a side, partial, close-up view of the upper quadrant showing the structure in greater detail and with part of the structure cut-away to better illustrate the rest of the structure, it being noted that in this figure and FIGS. 9 & 10, the inner, prop holding and cutting framework (30) is shown with the extended cutting members being each provided in two, separable parts for easy replacement of the cutting member's edges as they become worn, in contrast to the integral structure shown in FIGS. 1–7.
Figure 9:
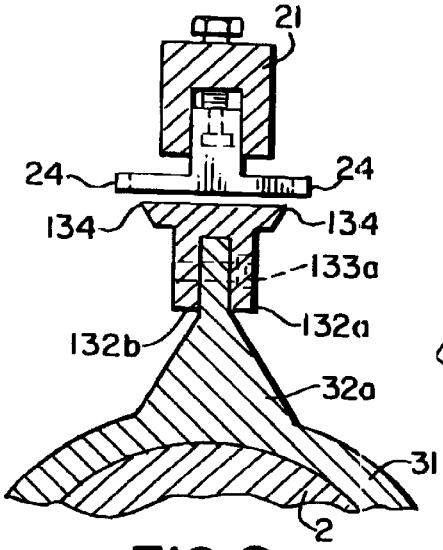
FIG. 9 is a partial, cross-sectional, detail view taken along section lines 9—9 in FIG. 8 of the embodiment of FIG. 1.
Figure 10:
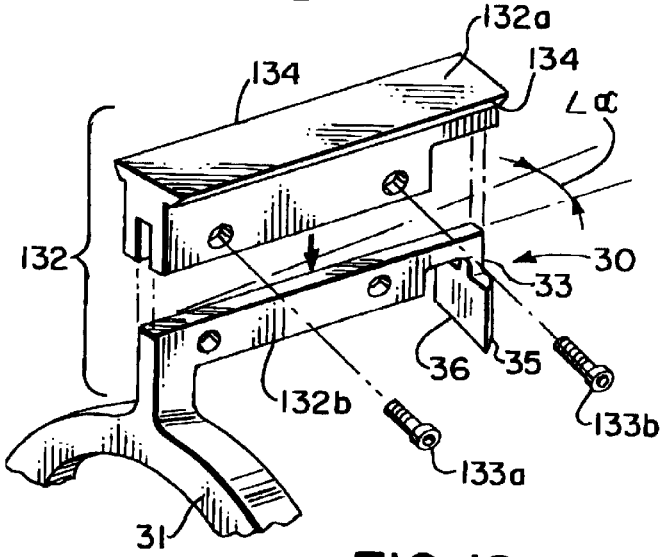
FIG. 10 is a perspective view of one of the cutting element with a removable cutting blade element, with the parts shown in exploded array.

It is noted that in FIGS. 8, 9 & 10, the inner, prop holding and cutting framework (30) is shown with the extended cutting members 132 each being provided in two, separable parts 132*a* & 132*b* for easy replacement of the cutting member's edges 134 as they become worn, in contrast to the integral structure 32*b* shown in FIGS. 1–7. As can best be seen in the exploded view of FIG. 10, the two parts 132*a* & 132*b* are removably held together by an exemplary two threaded bolts 133*a* & 133*b* used with two, standard, threaded nuts (not illustrated but well known) or otherwise appropriately secured with a reversible threaded engagement.

Each removable top arm 132*a* has side, cutting edges 134, comparable to the side cutting edges 34 for the top arms 32*b* (note, for example, FIG. 2). It should be understood that preferably and as illustrated, the forwardly extending arms 32*b*/132*a* are angled but also to the side, that is, in a direction that is not parallel to the longitudinal, center-line of the shaft 2. In essence, the arm portions 32*b*/132*a* lie in a cylindrical plane about the shaft center-line. However, it is noted that, due to the illustration of the angularity of the arm portions 32*b*/132*a* which exist in three dimensions, on a two dimensional surface, such as occurs in FIGS. 1 & 5–8, the drawings might be misinterpreted. However, the foregoing description should clear up any misinterpretation.

The side, cutting edges 33/134 come into close, rope severing proximity to the stationary abrading surfaces 24, with the small clearance spacing being substantially the same along their respective lengths, with a scissoring action occuring due to the sideward angle α and the resulting "delay" of one portion of the arms portions 32*b*/132*a* passing under the cutting edge surfaces 24.

The stationary, circular, abrading member or wheel 40 includes along its circumferential periphery a serrated, rope line severing surface 42. As the forward ends of the arms 32*b*/132*a* sweep past the serrated periphery 42, the forward ends of the side cutting edges 34/134 and the side (35) and bottom (36) cutting edges of the back blade 33 form close cutting edges to the serrated surface 42, as well as to the back side 41 (note FIG. 4) and the exterior, cylindrical surface of the support bearing 4, enhancing the interactive cutting and abrading actions produced by the relatively moving surfaces passing in very close proximity.

The same is also true for the close and varying proximity between the aft ends of the cutting edges 34/134 and the abrading surfaces 24. With all of the different angles and varying directions involved as the shaft 2 rotatably moves the inner framework 30 within and with respect to the fixed, outer framework 20, the interfacing, interrelated cutting and abrading structure will cause any entangling rope or line 5 to be cut into relatively small segments 5' (note FIG. 6).

Additionally, should the shaft 2 break, as illustrated in FIG. 7, the inner framework 30 will effectively hold the propeller 1 unto the fixed, support bearing 4 and its fixed structural members, for example, the support struts 6 by means of the aft surface 37 (FIG. 4) bearing against the back side 41 of the forward abrading member 40, with the latter being affixedly bolted to the support bearing 4 by a series of peripherally spaced bolts 44 (FIG. 3).

It is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A multi-element, rope line cutting system for a multi-bladed, marine propeller having a hub with a back side with a center-line defining the propeller's axis of rotation when used on a marine vessel for propulsion, the vessel having a static hull structure, a stuffing box and a drive shaft for the propeller, comprising:

a first set of equi-spaced arms defining a center-line and being attached to the hub of said propeller and extending out away from the back side of the hub in a direction at least generally in line with the center-line of the hub, the center-lines of the hub and said first set of arms being coincident;

a second set of arms associated with said first set of arms extendible in a direction opposite to that of said first set of arms and defining a center-line when so extended, said center-line of said second set of arms when so extended being coincident with said center-line of said first set of arms, one of the two sets of arms being nestable within the other, said first set of arms and said second set of arms each having at least one side edge surface configured to assist in the severing of any rope line that becomes entangled with the propeller when in active use on the marine vessel, one set of said two sets of arms being rotatable with respect to the other set of arms about their coincident center-lines, whereby their respective side edge surfaces of each set of arms are brought together in close proximity, creating a rope severing action between them, said second set of arms being fixedly attached to a static part of the vessel's hull structure; and a circular member with a back side and being attached orthogonally to the center-line of the vessel's stuffing box, which is used to hold the rotatable shaft for driving the propeller for propelling the vessel; each of said arms of said first set of arms having a terminal end extending downwardly past the back side of said circular member, interlocking the two sets of arms together, whereby, should the propeller shaft break, the propeller is maintained connected to the hull structure, preventing its loss.

2. The rope line cutting system for a marine propeller of claim 1, wherein:

said first set of arms is located nested within said second set of arms.

3. The rope line cutting system for a marine propeller of claim 2 wherein the multi-blades of the propeller each have a leading edge and a trailing edge with an open space between each's leading edge and the immediately adjacent blade's trailing edge defining an angled entry area based on the pitch of the blades, and wherein:

said first set of arms includes a central collar fixedly attached to the back side of the hub; and a first portion of said arms of said first set of arms each initially extends substantially radially outwardly at a location in line with a respective one of the open space between each adjacent set of blades, their being an arm at each open space; and a second portion of said arms of said first set of arms each thereafter extends at least generally longitudinally generally in a forward direction but at an angle to the side, substantially following the pitch angle of the open space between its respective set of adjacent blades.

4. The rope line cutting system for a marine propeller of claim 3, wherein:

said second portion of said arms of said first set of arms have side edge surfaces, each of which edge surface is configured to sever a rope line.

5. The rope line cutting system for a marine propeller of claim 4, wherein:

a first portion of said arms of said second set of arms each initially extends substantially radially outwardly; and a second portion of said arms of said second set of arms each thereafter extends at least substantially longitudinally at least in a substantially aft direction.

6. The rope line cutting system for a marine propeller of claim 5, wherein:

said second portion of said arms of said second set of arms have side edge surfaces, each of which side edge surface is configured to sever a rope line, said side edge surfaces of said second portion of said first set of arms passing in close proximity to said side edge surfaces of said second portion of said second set of arms, creating a severing, scissoring action between them as they relatively pass one another.

7. The rope line cutting system for a marine propeller of claim 3, wherein:

said second portion of said first set of arms being substantially located in a cylindrical plane about said coincident center-lines and extending at an angle to said coincident center-lines, with the angle being substantially equivalent to the pitch of the blades of the propeller.

8. The rope line cutting system for a marine propeller of claim 1, wherein:

said circular member has a circumferential, peripheral surface that has a surface configured to sever a rope line.

9. The rope line cutting system for a marine propeller of claim 8 wherein:

the configured surface is a serrated surface.

10. The rope line cutting system for a marine propeller of claim 1, wherein:

said terminal end has two side edge surfaces and a bottom edge surface, each of which is configured to sever a rope line.

11. The rope line cutting system for a marine propeller of claim 10, wherein:

said terminal end's two side edge surfaces and bottom edge surface are configured as cutting edges.

12. A multi-element, rope line cutting system for a multi-bladed, marine propeller having a hub with a back side with a center-line defining the propeller's axis of rotation when used on a marine vessel for propulsion, the multi-blades of the propeller each having a leading edge and a trailing edge with an open space between each's leading edge and the immediately adjacent blade's trailing edge defining an angled entry area based on the pitch of the blades, comprising:

a first set of equi-spaced arms defining a center-line and being attached to the hub of said propeller and extending out away from the back side of the hub in a direction at least generally in line with the center-line of the hub, the center-lines of the hub and said first set of arms being coincident; and a second set of arms associated with said first set of arms extendible in a direction opposite to that of said first set of arms and defining a center-line when so extended, said center-line of said second set of arms when so extended being coincident with said center-line of said first set of arms, one of the two sets of arms being nestable within the other, said first set of arms and said second set of arms each having at least one side edge surface configured to assist in the severing of any rope line that becomes entangled with the propeller when in active use on the marine vessel, one set of said two sets of arms being rotatable with respect to the other set of arms about their coincident center-lines, whereby their respective side edge surfaces of each set of arms are brought together in close proximity, creating a rope severing action between them;

said first set of arms including a central collar fixedly attached to the back side of the hub;

a first portion of said arms of said first set of arms each initially extending substantially radially outwardly at a location in line with a respective one of the open space between each adjacent set of blades, their being an arm at each open space; and a second portion of said arms of said first set of arms each thereafter extending at least generally longitudinally generally in a forward direction but at an angle to the side, substantially following the pitch angle of the open space between its respective set of adjacent blades.

13. The rope line cutting system for a marine propeller of claim 12, wherein:

said second portion of said arms of said first set of arms have side edge surfaces, each of which edge surface is configured to sever a rope line.

14. The rope line cutting system for a marine propeller of claim 13, wherein:

a first portion of said arms of said second set of arms each initially extends substantially radially outwardly; and a second portion of said arms of said second set of arms each thereafter extends at least substantially longitudinally at least in a substantially aft direction.

15. The rope line cutting system for a marine propeller of claim 14, wherein:

said second portion of said arms of said second set of arms have side edge surfaces, each of which side edge surface is configured to sever a rope line, said side edge surfaces of said second portion of said first set of arms passing in close proximity to said side edge surfaces of said second portion of said second set of arms, creating a severing, scissoring action between them as they relatively pass one another.

16. The rope line cutting system for a marine propeller of claim 12, wherein:

said second portion of said first set of arms being substantially located in a cylindrical plane about said coincident center-lines and extending at an angle to said coincident center-lines, with the angle being substantially equivalent to the pitch of the blades of the propeller.

17. A propeller retention system for a multi-bladed, marine propeller having a hub with a back side with a center-line defining the propeller's axis of rotation when used on a marine vessel for propulsion, the vessel having a static hull structure, a stuffing box and a drive shaft for the propeller, comprising:

a first set of equi-spaced arms defining a center-line and being attached to the hub of said propeller and extending forward out away from the back side of the hub in a direction at least generally in line with the center-line of the hub;

a circular member with a back side and being attached orthogonally to the center-line of the vessel's stuffing box, which is used to hold the rotatable shaft for driving the propeller for propelling the vessel; each of said arms of said first set of arms having a terminal end extending downwardly in the radial sense past the back side of said circular member, whereby, should the propeller shaft break, the propeller is maintained connected to the hull structure, preventing its loss.

18. The rope line cutting system for a marine propeller of claim 17, wherein:

said circular member has a circumferential, peripheral surface that has a surface configured to sever a rope line.

19. The rope line cutting system for a marine propeller of claim 18, wherein:

the configured surface is a serrated surface.

20. The rope line cutting system for a marine propeller of claim 17, wherein:

said terminal end has two side edge surfaces and a bottom edge surface, each of which is configured to sever a rope line.

21. The rope line cutting system for a marine propeller of claim 20, wherein:

said terminal end's two side edge surfaces and bottom edge surface are configured as cutting edges.

22. A multi-element, rope line cutting system for a multi-bladed, marine propeller having a hub with a back side with a center-line defining the propeller's axis of rotation when used on a marine vessel for propulsion, the multi-blades of the propeller each have a leading edge and a trailing edge with an open space between each's leading edge and the immediately adjacent blade's trailing edge defining an angled entry area based on the pitch of the blades, comprising:

a first set of equi-spaced arms defining a center-line and being attached to the hub of said propeller and extending out away from the back side of the hub in a direction at least generally in line with the center-line of the hub, the center-lines of the hub and said first set of arms being coincident; said first set of arms including a central collar fixedly attached to the back side of the hub; and a first portion of said arms of said first set of arms each initially extending substantially radially outwardly at a location in line with a respective one of the open space between each adjacent set of blades, their being an arm at each open space; and a second portion of said arms of said first set of arms each thereafter extending at least generally longitudinally generally in a forward direction but at an angle to the side, substantially following the pitch angle of the open space between its respective set of adjacent blades.

23. The rope line cutting system for a marine propeller of claim 22, wherein:

said second portion of said arms of said first set of arms have side edge surfaces, each of which edge surface is configured to sever a rope line.

24. The rope line cutting system for a marine propeller of claim 23, wherein there is further included:

a second set of arms associated with said first set of arms extendible in a direction opposite to that of said first set of arms and defining a center-line when so extended, said center-line of said second set of arms when so extended being coincident with said center-line of said first set of arms, one of the two sets of arms being nestable within the other, said first set of arms and said second set of arms each having at least one side edge surface configured to assist in the severing of any rope line that becomes entangled with the propeller when in active use on the marine vessel, one set of said two sets of arms being rotatable with respect to the other set of arms about their coincident center-lines, whereby their respective side edge surfaces of each set of arms are brought together in close proximity, creating a rope severing action between them; and wherein:

a first portion of said arms of said second set of arms each initially extends substantially radially outwardly; and a second portion of said arms of said second set of arms each thereafter extends at least substantially longitudinally at least in a substantially aft direction.

25. The rope line cutting system for a marine propeller of claim 24, wherein:

said second portion of said arms of said second set of arms have side edge surfaces, each of which side edge surface is configured to sever a rope line, said side edge surfaces of said second portion of said first set of arms passing in close proximity to said side edge surfaces of said second portion of said second set of arms, creating a severing, scissoring action between them as they relatively pass one another.

26. The rope line cutting system for a marine propeller of claim 24, wherein:

said second portion of said first set of arms being substantially located in a cylindrical plane about said coincident center-lines and extending at an angle to said coincident center-lines, with the angle being substantially equivalent to the pitch of the blades of the propeller.

* * * * *